US005870110A

United States Patent [19]

Mallory

[11] Patent Number: 5,870,110

[45] Date of Patent: Feb. 9, 1999

[54] HAND HELD MESSAGING SYSTEM

[76] Inventor: Perry M. Mallory, 114 Blue Flag Ct., Whitehouse Station, N.J. 08889

[21] Appl. No.: 847,716

[22] Filed: Apr. 28, 1997

[51] Int. Cl.[6] ..... G09G 5/00

[52] U.S. Cl. ..... 345/903; 345/168; 40/593

[58] Field of Search ..... 345/168, 169, 345/171, 901, 903, 905; 40/593, 719

[56] References Cited

U.S. PATENT DOCUMENTS

| | | | |
|---|---|---|---|
| 1,640,011 | 8/1927 | Semerfleck | 40/719 |
| 4,672,759 | 6/1987 | Docherty et al. | 40/450 |
| 4,738,042 | 4/1988 | Corden et al. | 40/472 |
| 4,929,936 | 5/1990 | Friedman et al. | 345/117 |
| 5,146,615 | 9/1992 | Hodsdon et al. | 345/168 |
| 5,241,768 | 9/1993 | Thompson | 40/593 |
| 5,542,770 | 8/1996 | Lin | 345/171 |
| 5,579,034 | 11/1996 | Aoyama et al. | 345/168 |
| 5,657,052 | 8/1997 | Lerude | 345/168 |
| 5,661,476 | 8/1997 | Wang et al. | 345/169 |
| 5,703,624 | 12/1997 | van Kruistum | 345/169 |
| 5,710,576 | 1/1998 | Nishiyama et al. | 345/169 |

*Primary Examiner*—Matthew Luu

*Attorney, Agent, or Firm*—Michael I. Kroll

[57] ABSTRACT

A hand held device for displaying a message. The device includes a keypad including a plurality of keys for inputting data indicative of the message to be displayed and generating a message signal based upon the received signals, a microprocessor for receiving and interpreting the message signal from the keypad and producing a display signal based upon the interpretation and a display device for receiving the display signal from the microprocessor and displaying a message representative of the received display signal. A power supply is connected to supply power to the microprocessor, display device and keypad and a plurality of templates may be removably positioned over the keypad to identify each key of said keypad, each template represents a different language in which the message may be displayed. The desired language for selection of the message is selected prior to inputting the message and the corresponding template is then positioned to cover the keypad to properly identify the keys. The keypad, micro processor means and display device are all contained within a housing which includes a handle for holding the device in an upright position, a window through which the keypad is viewable and a slot leading to the window through which the template corresponding to the selected language is removeably positioned to cover the keypad.

10 Claims, 5 Drawing Sheets

HAND HELD MESSAGING SYSTEM

BACKGROUND OF THE INVENTION

1. Field of the Invention

The instant invention relates generally to messaging devices and, more specifically, to a programmable hand held messaging device.

2. Description of the Prior Art

Numerous devices for presenting messages on a message board have been provided in the prior art. For example, U.S. Pat. Nos. 4,672,759; 4,738,042; and 4,929,936 are all illustrative of such prior art. While the units may be suitable for the particular purpose to which they address, they would not be as suitable for the purposes of the present invention as heretofore described.

U.S. Pat. No. 4,672,759

Inventor: Brian Doeherty et al.

Issued: Jun. 16, 1987

Digits of a multi-digit alphanumeric display have eight segments, viz a conventional seven segment arrangement plus an eighth. The attitude/position of the eighth segment differs from digit to digit, the pattern of variation being selected so that a limited repertoire of words and phrases can be displayed without the provision of full alphanumeric capability on all digits.

U.S. Pat. No. 4,738,042

Inventor: Paul H. Corden et al.

Issued: Apr. 19, 1988

A commercial merchandising unit for displaying products for sale is integrally provided with a device displaying moving merchandising message indicia. Fixed merchandising message indicia may further be integrally combined in the general vicinity of the moving indicia. The integral appearance of either the moving indicia, or the fixed and moving indicia, combined with a merchandising unit, such as a refrigerated display case, significantly enhances the merchandising affect of the merchandising indicia.

U.S. Pat. No. 4,929,936

Inventor: Don Friedman et al.

Issued: May 29, 1990

A lighted sign, particularly useful for identifying a residence number on a street, has a display panel having a plurality of aligned numbers illuminated by LED's which are selectively programmable by the user to display the proper house number. In the event of an emergency, the sign is changeable to an emergency mode in which the numbers flash intermittently, and the LED's change from a first color to a red color indicating the emergency. The sign is activated manually or by means of a photocell, and the emergency condition may be actuated by a manual switch for a remote transmitter. The device may also be used to activate other emergency alert signals, such as an audible signal or a signal transmitter over phone lines.

BRIEF SUMMARY OF THE INVENTION

The present invention is concerned with message displays and, more specifically, to programmable hand held message display devices.

A primary object of the present invention is to provide a device for displaying a message which is light weight and able to be hand held.

Another object of the present invention is to provide a device for displaying a message which is readily visible.

A further object of the present invention is to provide a device for displaying a message which is programmable and therefore able to display any desired message.

Another object of the present invention is to provide a device for displaying a message in a plurality of languages.

A further object of the present invention is to provide a device for displaying a message which is adaptable for hanging in a car window.

A still further object of the present invention is to provide a device for displaying a message in a plurality of colors.

An even further object of the present invention is to provide a device for displaying a message which is able to flash on and off.

A yet further object of the present invention is to provide a device for displaying a message which scrolls across the display area.

A still further object of the present invention is to provide a device for displaying a message which is also able to display a company logo.

An even further object of the present invention is to provide a device for displaying a message which is adaptable for connection to an external power supply such as a cigarette lighter in a car.

A yet further object of the present invention is to provide a device for displaying a message which is easy to use.

A still further object of the present invention is to provide a device for displaying a message which is inexpensive to manufacture.

A hand held device for displaying a message is disclosed by the present invention. The device includes a keypad including a plurality of keys for inputting data indicative of the message to be displayed and generating a message signal based upon the received signals, a microprocessor for receiving and interpreting the message signal from the keypad and producing a display signal based upon the interpretation and a display device for receiving the display signal from the microprocessor and displaying a message representative of the received display signal. A power supply is connected to supply power to the microprocessor, display device and keypad and a plurality of templates may be removably positioned over the keypad to identify each key of said keypad, each template represents a different language in which the message may be displayed. The desired language for selection of the message is selected prior to inputting the message and the corresponding template is then positioned to cover the keypad to properly identify the keys. The keypad, microprocessor means and display device are all contained within a housing which includes a handle for holding the device in an upright position, a window through which the keypad is viewable and a slot leading to the window through which the template corresponding to the selected language is removeably positioned to cover the keypad.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
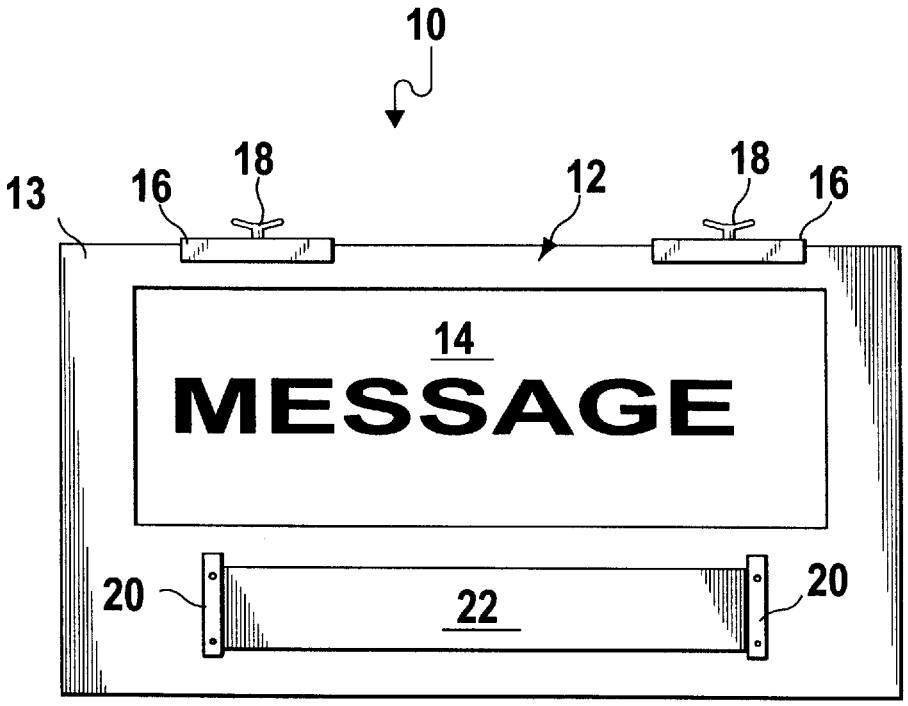
FIG. 1 is a perspective view of the hand held messaging device of the present invention.

Turning now descriptively to the drawings, in which similar reference characters denote similar elements throughout the several views, the Figures illustrate a message display apparatus in accordance with the present invention. With regard to the reference numerals used, the following numbering is used throughout the various drawing figures.

10 the hand held messaging device of the present invention
12 housing
13 face side
14 message display
16 brackets
18 wing nuts for hanging message display in car
20 riveted bar
22 shield
24 keypad
26 microprocessor
28 disk drive
30 internal power source
32 power switch
34 external power source
36 message flash switch
38 color switch
40 back side
42 external power source connector
43 window
44 keypad
46 handle
48 top side
50 slot for inserting keypad template
52 recess in bracket
54 bottom side
56 disk drive slot
58 disk drive entrance
60 window clamp
62 car window

DETAILED DESCRIPTION OF THE PREFERRED EMBODIMENT

A preferred embodiment of the device of the present invention will now be described with reference to FIGS. 1–7.

FIG. 1 illustrates the message device of the present invention indicated generally by the numeral 10. The message device 10 includes a housing 12, a face side 13 of which is depicted in FIG. 1. A message display 14 is viewable on the face side 13 for displaying a desired message. The message display 14 may be an LED display or any other known form for producing an illuminating signal or message. A pair of brackets 16 can be seen as extending partially over a top of the face side 13 and a wing nut 18 can be seen as extending above the brackets 16. The brackets 16 are ninety (90) degree brackets which are positioned on a top side of the device and hang over at their ninety degree bend to contact and engage the face side 13. Positioned beneath the message display 14 are a pair of riveted bars 20 with a shield 22 removably attached to and between the riveted bars 20. The combination of the riveted bars 20 and the shield 22 may be used to position an additional message such as a company logo or identification below the shield 22. The additional message is held in place behind the shield 22 by the riveted bars 20. The shield is made of a clear material such as plastic, lucite or any other polyurethane material whereby when the shield is placed to cover a message board or sign, the message board or sign is clearly visible through the shield.

Figure 3:
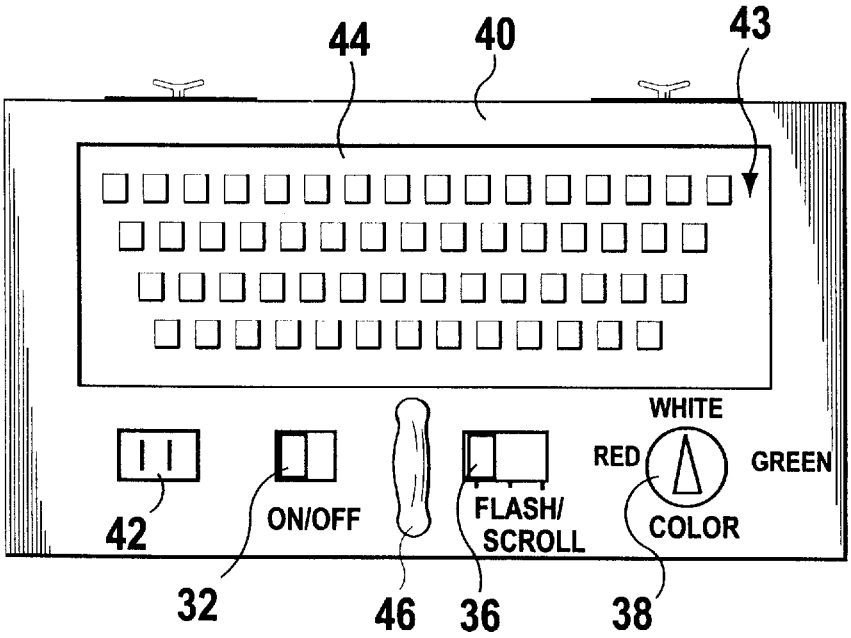
FIG. 3 is a rear view of the hand held messaging device of the present invention.

A rear side 40 of the display apparatus is illustrated in FIG. 3. The rear side 40 includes an adapter 42 for connecting an external power supply; a power switch 32; a switch 36 for changing the display of the message between a normal display mode, a flash mode or a scroll mode; and a color switch 38 for changing the color of the displayed message. A window 43 is provided for viewing a template 44 positioned therein. The template 44 is used to cover a keypad which is connected for inputting the message to be displayed to a microprocessor, operation of the keypad and microprocessor will be explained hereinafter. The template 44 includes a design corresponding to keys on a keyboard and is used to identify the keys which they cover. A plurality of different templates 44 may be used, each template 44 corresponds to a keyboard used for a particular language. The particular template 44 chosen to be placed behind the window 43 is dependent upon the language selected for display of the message. A handle 46 also extends from the back side 40 for holding the message device 10 by a user.

Figure 4:
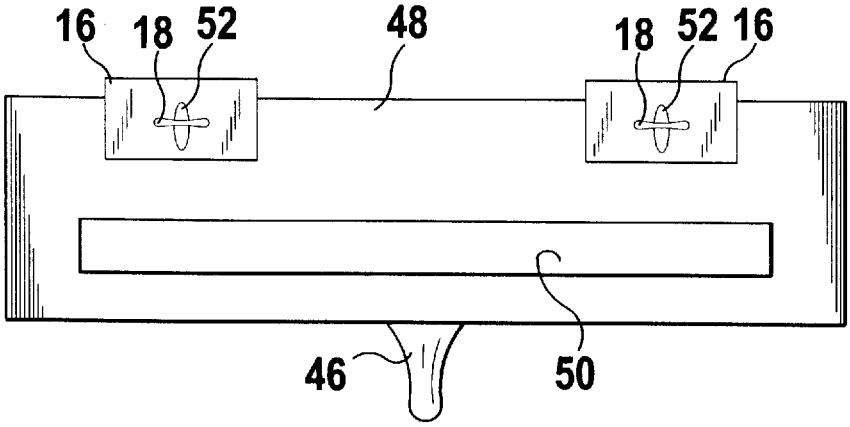
FIG. 4 is a top view of the hand held messaging device of the present invention.

A view of the top side 48 is illustrated in FIG. 4 wherein a slot 50 for insertion and removal of the template 44 can be seen. The template 44 is replaceable and thus different templates 44 containing key patterns for different languages can be used depending upon the selection of a desired language for display of the message. Also depicted in this figure are the two brackets 16 attached to the top side 48 thereof. The brackets 16 each contain a slot 52 through which the wing nut screw 18 extends. It is to be realized that any number of brackets 16 and wing nut screws 18 may be used. The use of two brackets 16 and wing nut screws 18 is for purposes of example only and not meant to limit the present invention.

Figure 5:
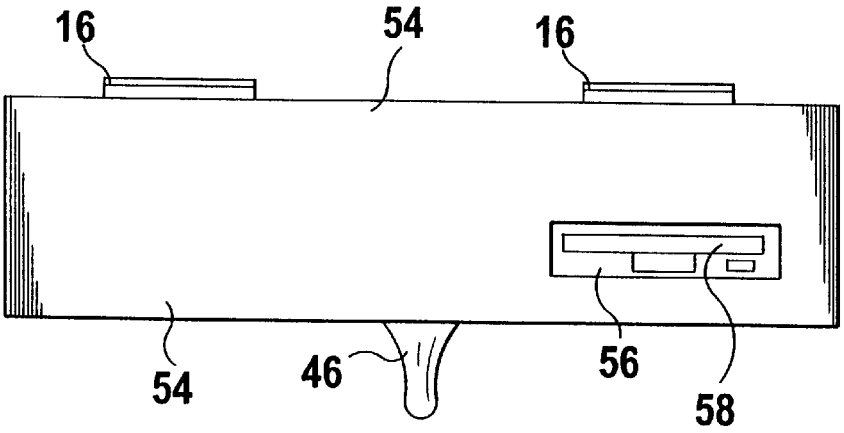
FIG. 5 is a bottom view of the hand held messaging device of the present invention.

A bottom side 54 of the housing 12 is illustrated in FIG. 5. A disk drive 56 having an entry slot 58 is positioned on this side 54 for inserting a diskette including information regarding the word processing program and language to be used for producing the message to be displayed. The insertable diskette may contain a word processing program for any or a particular desired language thereby providing the ability to type in a message in any language. When loading the information contained on the diskette into the device, the device will store the information within the microprocessor and use it to produce the message to be displayed. The template 44 inserted will correspond to the selected language associated with the information on the diskette. The disk drive 56 may also be positioned on any other side of the device 10. Positioning the disk drive 56 on the bottom side 54 is for purposes of example only and not meant to limit the scope of the invention.

Figure 6:
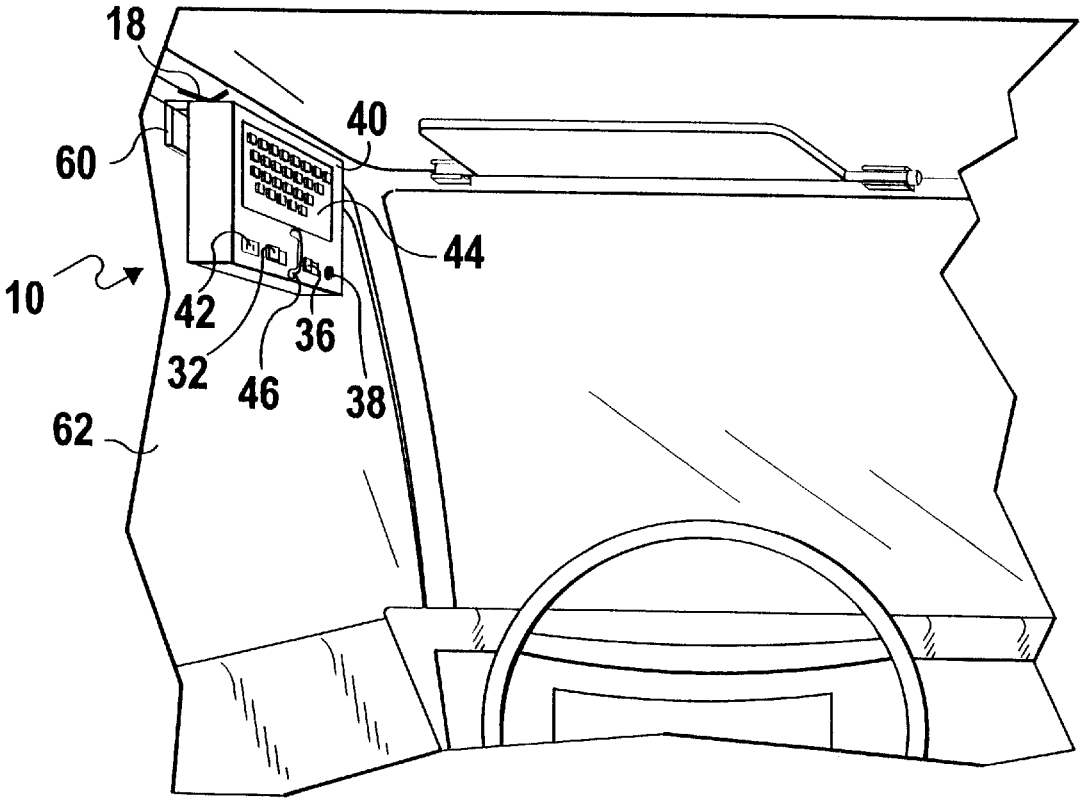
FIG. 6 is a perspective view of the hand held messaging device of the present invention hanging within a car window.

The messaging device 10 can also be positioned to be viewable through a car window 62 or the like as is illustrated in FIG. 6. A window clamp 60 must be placed to hang over the car window 62 whereby a portion of the clamp 60 hangs on an outer side of the window 62 and the window 62 is in a closed position securing the clamp 60 in position. The wing nut bolts 18 are positioned to engage the clamp 60 and hold the device 10 in a position in which it can be viewed in the window 62.

Figure 2:
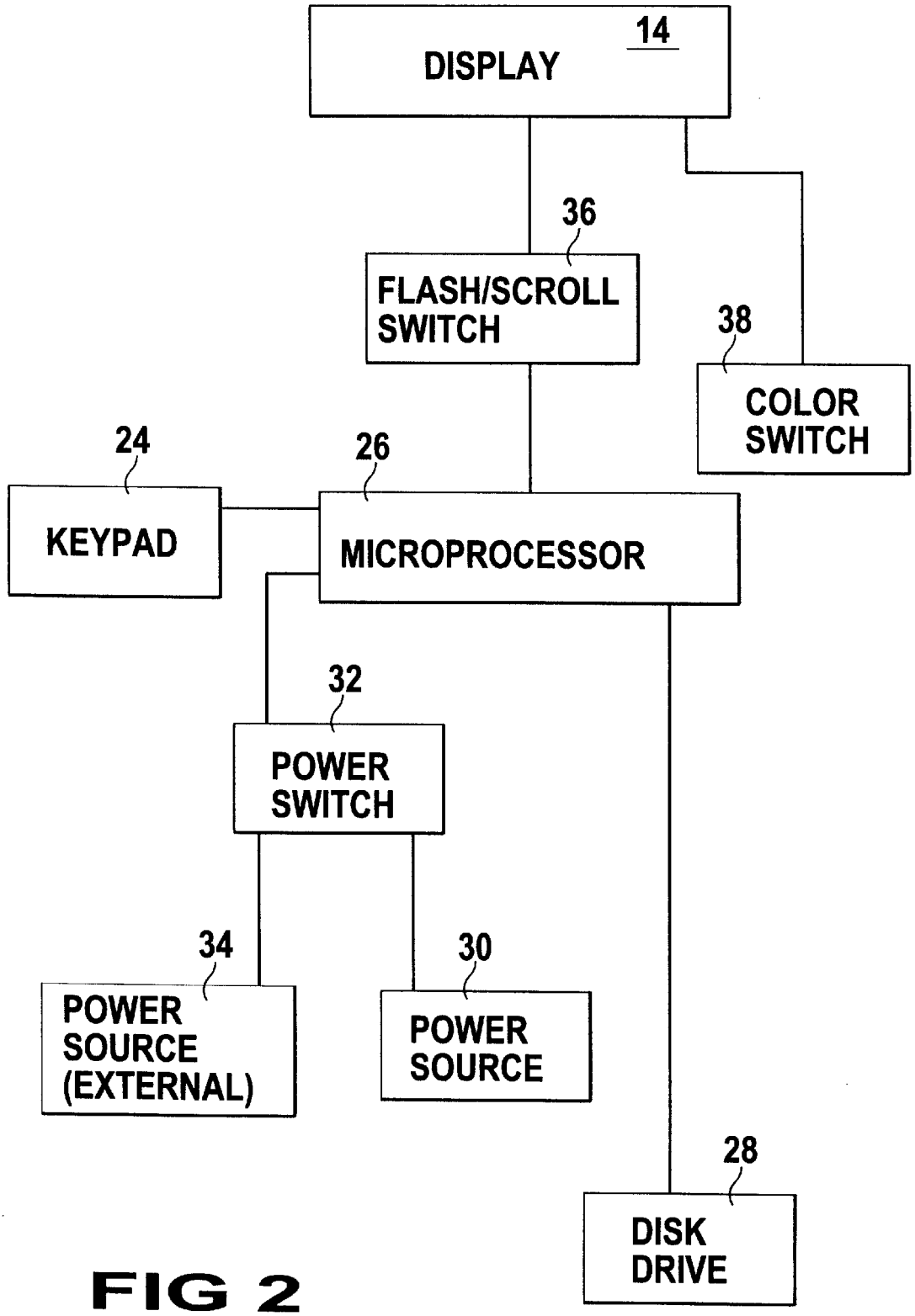
FIG. 2 is a schematic diagram of the hand held messaging device of the present invention.

The internal components of the device are shown in the schematic diagram of FIG. 2. The device 10 contains an internal power source 30 and a coupler 42 for connection to an external power source. The power source 30 or 32 supplies power to a microprocessor 26. The internal power source 30 is known in the art and, for example, may be a rechargeable battery as is known in the art and used to power laptop computers. The external power source may be a car cigarette lighter or a wall outlet wherein an appropriate adapter will be connected to the connection port 42. The microprocessor 26 contains a memory and is able to store information such as a word processing program to be used for producing the message to be displayed therein. A keypad 24 and disk drive 28 are also connected to the microprocessor 26. The disk drive 28 is used to input information relating to the language to be used for displaying the message and thus instructs the microprocessor 26 on how to interpret input signals received from the keypad 24. If the microprocessor 26 includes a large enough memory, the disk drive 28 may not be necessary and a separate key on the keypad 24 may be assigned to each possible language for selecting the language in which the message will be displayed. Selection of the language to be used from a key on the keypad 24 will act to signal the microprocessor 26, directing the microprocessor 26 on how to interpret the signals received from the keypad 24. The keypad 24 also includes a clear key for clearing the message input thereto and displayed on the LED message display 14. The keypad 24 and its connection to the microprocessor 26 is known in the art, such as the keypad used in a laptop computer or electronic organizer, and thus further discussion of such is not necessary. Upon interpretation of the message signal received from the keypad 24 the microprocessor 26 sends a signal to the display 14 via a switch 36. The switch 36 is used to select a flash mode or scroll mode for display of the message. This will provide a special effect for the message thus causing the message to be more visible. Also connected to the display 14 is a switch 38 to select the color of light in which the message is displayed to add further effect and enhancement to the message.

While a preferred structure for the microprocessor 26 is shown and described herein, those of ordinary skill in the art who have read this description will appreciate that there are numerous other structures for the microprocessor 26 and, therefore, as used herein the phrase "microprocessor means for receiving and interpreting signals from a keypad and producing a display signal based upon the interpretation" should be construed as including all such structures as long as they achieve the desired result of receiving and interpreting signals from a keypad and producing a display signal based upon the interpretation receiving and interpreting signals from a keypad and producing a display signal based upon the interpretation, and therefore, that all such alternative mechanisms are to be considered as equivalent to the one described herein.

The key pad 24 and disk drive 28 are commonly known components and further discussion of such is not deemed necessary. The interpretation of the signals generated by pressing the keys of the keypad 24 are defined by the microprocessor 24 and the data input thereto via a diskette inserted into the disk drive 28. Thus, the keypad 24 can be used to produce messages in a plurality of languages by simply changing the definition associated with the keys thereon in a manner similar to changing fonts when using a word processing program.

Figure 7:
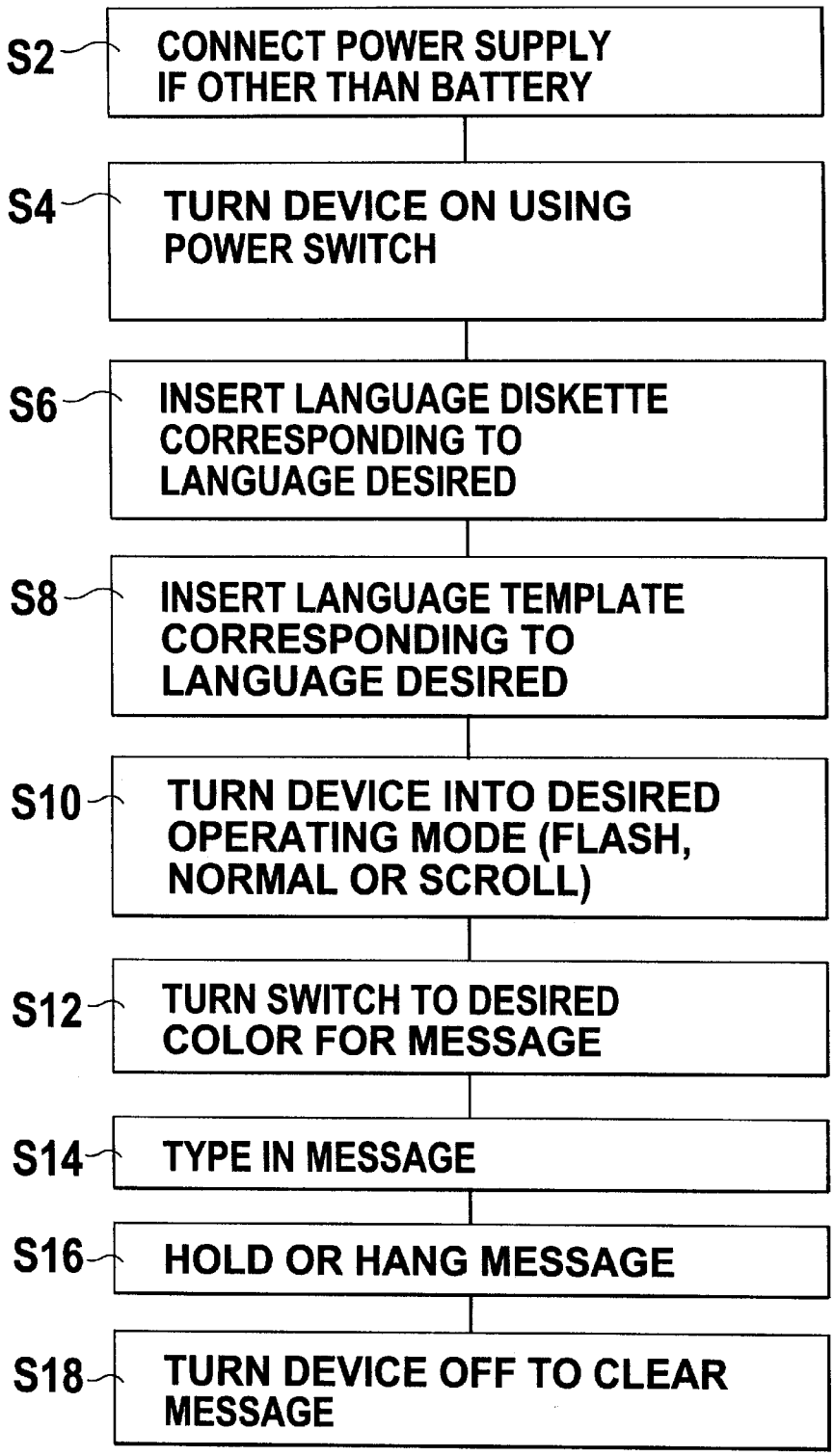
FIG. 7 is a flow chart describing operation of the hand held messaging device of the present invention.

The operation of the device will now be described with reference to FIG. 7. In operation, a power supply 32 is connected to the device 10 via the connection port 42 if an external power source is used and the device 10 is turned on via the power switch 32. An internal battery 30 is contained within the housing 12 and is tapped for power if an external source is either not used or unavailable as described in steps S2 and S4. If the microprocessor 26 does not have the desired language stored within its memory, a diskette containing the desired language is inserted into the disk drive 28 and the information contained thereon input to the microprocessor 26 as described in step S6. The information on the diskette may be either automatically read into the microprocessor 26 upon entry into the disk drive 28 or may be accomplished via a series of keystroke commands input through the keypad 24. A key on the keypad 24 corresponding to the desired language is then pressed to signal the microprocessor 24, identifying how the signals received from the keypad are to be interpreted and a language template 44 corresponding to the selected language for use in displaying the message is then inserted through the slot 50 to be viewable through the window 43 as stated in step S8. A desired operating mode, i.e. flashing, normal or scrolling, is then selected along with the color in which the message is to be displayed as disclosed in steps S10 and S12.

It is now time to type the message on to the template 44 covering the keypad 24 for processing by the microprocessor 26 and display on the device 10, step S14. When keys on the keypad 24 are pressed, a signal indicative of the pressed key is transmitted to the microprocessor 26 which interprets the received signal to determine which key was pressed. Upon determining which key was pressed, the microprocessor 26 sends a signal to the message display 14 causing it to display a letter corresponding to the pressed key. This process is repeated until the entire message is displayed.

The device is then either held by a user using the handle 46 or hung on a clamp 60 such as previously described, as stated in step S16. The message is displayed for a desired amount of time and when the message is no longer useful, the clear button on the keypad 44 is pressed and the message is erased as described in step S18. The message may also be erased by turning the power switch to the off position. A new message may now be typed therein for display on the device.

The present invention is thus able to provide a device for displaying a message which is easy to use and inexpensive to manufacture. The device is also light weight and thus able to be supported by one hand of a user, displays a message which is readily visible and is programmable to display any desired message in a plurality of languages. The messages can also be displayed and viewed hanging in a car window. Furthermore, the message can be displayed in a plurality of colors and can either flash or scroll across the display area. Power may be supplied to the device by either an internal battery or via a connection to an external power supply such as a cigarette lighter in a car.

It will be understood that each of the elements described above, or two or more together, may also find a useful application in other types of applications differing from the type described above.

While the invention has been illustrated and described as shown in the drawings, it is not intended to be limited to the details shown, since it will be understood that various omissions, modifications, substitutions and changes in the forms and details of the formulation illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of this invention.

What is claimed as new and desired to be protected by Letters Patent is set forth in the appended claims:

1. A hand held device for displaying a message, comprising:

a) a keypad including a plurality of keys for inputting data indicative of the message to be displayed and generating a message signal based upon the received signal;

b) microprocessor means for receiving and interpreting said message signal from said keypad and producing a display signal based upon said interpretation;

c) display means for receiving said display signal from said microprocessor means and displaying a message representative of said received display signal, said display means including a display panel for displaying said message;

d) a power supply for supplying power to said microprocessor means, display means and keypad;

e) replaceable template means positioned to cover said keypad for identifying each key of said keypad;

f) means for housing said keypad, microprocessor means and display means including a handle for holding said device in an upright position, a window through which said keypad is viewable and slot means leading to said window through which said template is removably positioned to cover said keypad;

g) said housing means comprising a housing having a face side and a rear side on opposite sides of said housing and substantially parallel to each other, and top and bottom edges, said display panel being mounted on said face side, and said keypad being mounted on said rear side;

h) said slot means being mounted along said top edge of said housing in a manner to permit said template to be inserted and removed without altering said housing; and i) means mounted on said top edge for suspending said housing in a manner to provide a public display of said display panel.

2. The hand held device for displaying a message as recited in claim 1, further comprising a disk drive for receiving data indicative of a language in which said message is to be displayed and transmitting said data to said microprocessor for use in interpreting said message signals.

3. The hand held device for displaying a message as recited in claim 1, wherein said keypad includes a clear key for clearing the display means of a message displayed thereon.

4. The hand held device for displaying a message as recited in claim 3, wherein said keypad said mounted means includes a plurality of language keys, each of said plurality of language keys corresponding to a particular language and for directing said microprocessor means to interpret said message signal in accordance with a predetermined protocol associated with said language.

5. The hand held device for displaying a message as recited in claim 1, further comprising a flash means connected to said display means for causing said message displayed on said display means to flash.

6. The hand held device for displaying a message as recited in claim 5, further comprising scroll means connected to said display means for scrolling said message displayed on said display means to scroll across said display means.

7. The hand held device for displaying a message as recited in claim 6, further comprising means for changing a color of the message displayed on said display means.

8. The hand held device for displaying a message as recited in claim 1, further comprising a clamp, at least one bracket connected to said housing and at least one wing nut extending from said bracket, wherein said wing nut engages said clamp for hanging said device in a predetermined position.

9. The hand held device for displaying a message as recited in claim 1, further comprising a message board, first and second riveted brackets connected to said housing and a shield positioned to cover said message board connected between said first and second riveted brackets for retaining said message board between said first and second riveted brackets.

10. The hand held device for displaying a message as recited in claim 8, wherein said shield is formed of a clear material and said message board is viewable when covered by said shield.

* * * * *